US007193566B2

(12) United States Patent
Chen et al.

(10) Patent No.: US 7,193,566 B2
(45) Date of Patent: Mar. 20, 2007

(54) PLANAR MONOPOLE ANTENNAS

(75) Inventors: Chih-Lung Chen, Taipei (TW); Chih-Kai Liu, Taipei (TW)

(73) Assignee: Wistron NeWeb Corp, Taipei Hsien (TW)

( * ) Notice: Subject to any disclaimer, the term of this patent is extended or adjusted under 35 U.S.C. 154(b) by 41 days.

(21) Appl. No.: 11/223,391

(22) Filed: Sep. 8, 2005

(65) Prior Publication Data

US 2006/0232478 A1 Oct. 19, 2006

(30) Foreign Application Priority Data

Apr. 18, 2005 (TW) ..... 94112244 A

(51) Int. Cl.
*H01Q 1/38* (2006.01)

(52) U.S. Cl. ..... 343/700 MS; 343/833; 343/834; 343/846

(58) Field of Classification Search ..... 343/700 MS, 343/846, 702, 833, 834
See application file for complete search history.

(56) References Cited

U.S. PATENT DOCUMENTS

| | | | |
|---|---|---|---|
| 6,392,599 | B1 | 5/2002 | Ganeshmoorthy et al. |
| 6,559,809 | B1 | 5/2003 | Mohammadian et al. |
| 2002/0057227 | A1* | 5/2002 | Fang ..... 343/895 |

FOREIGN PATENT DOCUMENTS

| | | | |
|---|---|---|---|
| EP | 1 469 554 | A1 | 10/2004 |
| WO | WO 98/38694 | | 9/1998 |
| WO | WO 2004/102742 | A1 | 11/2004 |

OTHER PUBLICATIONS

Pey-Ling Teng et al, "Multi-Frequency Planar Monopole Antenna for GSM/DCS/PCS/WLAN Operation," *Microwave and Optical Technology Letters*, vol. 36, No. 5, 2003, pp. 350-352, Wiley Periodicals, Inc., USA.

M. Rahman et al, "Dual-Band Strip-Sleeve Monopole for Handheld Telephones," *Microwave and Optical Technology Letters*, vol. 21, No. 2, 1999, pp. 79-82, John Wiley & Sons, Inc., USA.

Maria A. Stuchly et al, "Modeling Antenna Close to the Human Body," *IEEE*, vol. 5, 2000, pp. 83-89, USA.

* cited by examiner

*Primary Examiner*—Hoang V. Nguyen
(74) *Attorney, Agent, or Firm*—Quintero Law Office

(57) ABSTRACT

Planar monopole antennas. A planar monopole antenna for communicating radio signals within a specific frequency range includes a substrate, a ground, a first sleeve, a second sleeve and a radiator. The radiator and the ground are formed on the substrate. The first and second sleeves project from a side of the ground in a first direction, wherein the first sleeve has a first length, and the second sleeve has a second length in the first direction. The side of the ground defines a third length. The radiator has a fourth length in the first direction, substantially equal to the sum of the first, second, and third lengths.

20 Claims, 5 Drawing Sheets

PLANAR MONOPOLE ANTENNAS

BACKGROUND

The invention relates in general to planar monopole antennas and in particular to planar monopole antennas with sleeve structures.

Embedded antennas, such as chip antennas and planar antennas, are widely applied in wireless communication devices. A conventional type is a ceramic chip antenna produced by LTCC (Low Temperature Co-fired Ceramic) technology. Conventional planar antennas such as microstrip antennas, printed antennas and Planar Inverted F Antennas (PIFAs), are generally applied in GSM, DCS, UMTS, WLAN, and bluetooth wireless equipment such as mobile phones and wireless LAN adapters.

Referring to FIG. 1, a conventional planar monopole antenna primarily comprises a substrate S, a ground G, a radiator R and a cable W. The ground G and the radiator R are formed on a surface S1 of the substrate S, and the radiator R is longitudinal along axis Y.

The cable W, such as a coaxial cable, comprising a signal wire W1 and a ground wire W2 enclosing the signal wire W1. As shown in FIG. 1, the radiator R comprises a feed end RF adjacent to the ground G. The feed end RF is connected to the signal wire W1, and the ground G is connected to the ground wire W2, respectively.

With respect to typical frequency range of Digital Video Broadcasting (460~860 MHz), the frequency coverage ratio of a conventional planar monopole antenna as shown in FIG. 1 is usually less than 30%, adversely affecting communication efficiency.

SUMMARY

The present invention provides a planar monopole antenna for communicating radio signals within a specific frequency range. An exemplary embodiment of a planar monopole antenna includes a substrate, a ground, a first sleeve, a second sleeve and a radiator. The radiator and the ground are formed on the substrate. The first and second sleeves project from a side of the ground in a first direction, wherein the first sleeve has a first length, and the second sleeve has a second length in the first direction. The side of the ground defines a third length from the first sleeve to the second sleeve. The radiator has a fourth length in the first direction, substantially equal to the sum of the first, second, and third lengths.

The present invention further provides a planar monopole antenna including a substrate, a ground, a first sleeve, a second sleeve, a radiator and a cable connecting the radiator for communicating radio signals within a specific frequency range. The first sleeve is formed on the substrate and electrically connected to the ground, wherein the first sleeve projects from a side of the ground in a first direction with a first length. The second sleeve is formed on the substrate and electrically connected to the ground, wherein the second sleeve projects from the side of the ground in the first direction with a second length, and the side of the ground defines a third length. The longitudinal radiator is formed on the substrate and situated between the first and second sleeves, wherein the radiator comprises a main body and two L-shaped angle portions symmetrical with respect to the main body. Specifically, the angle portions are substantially extend opposite to the first direction, wherein total length of the main body and each of the angle portions is substantially equal to the sum of the first, second, and third lengths.

DETAILED DESCRIPTION

Figure 1:
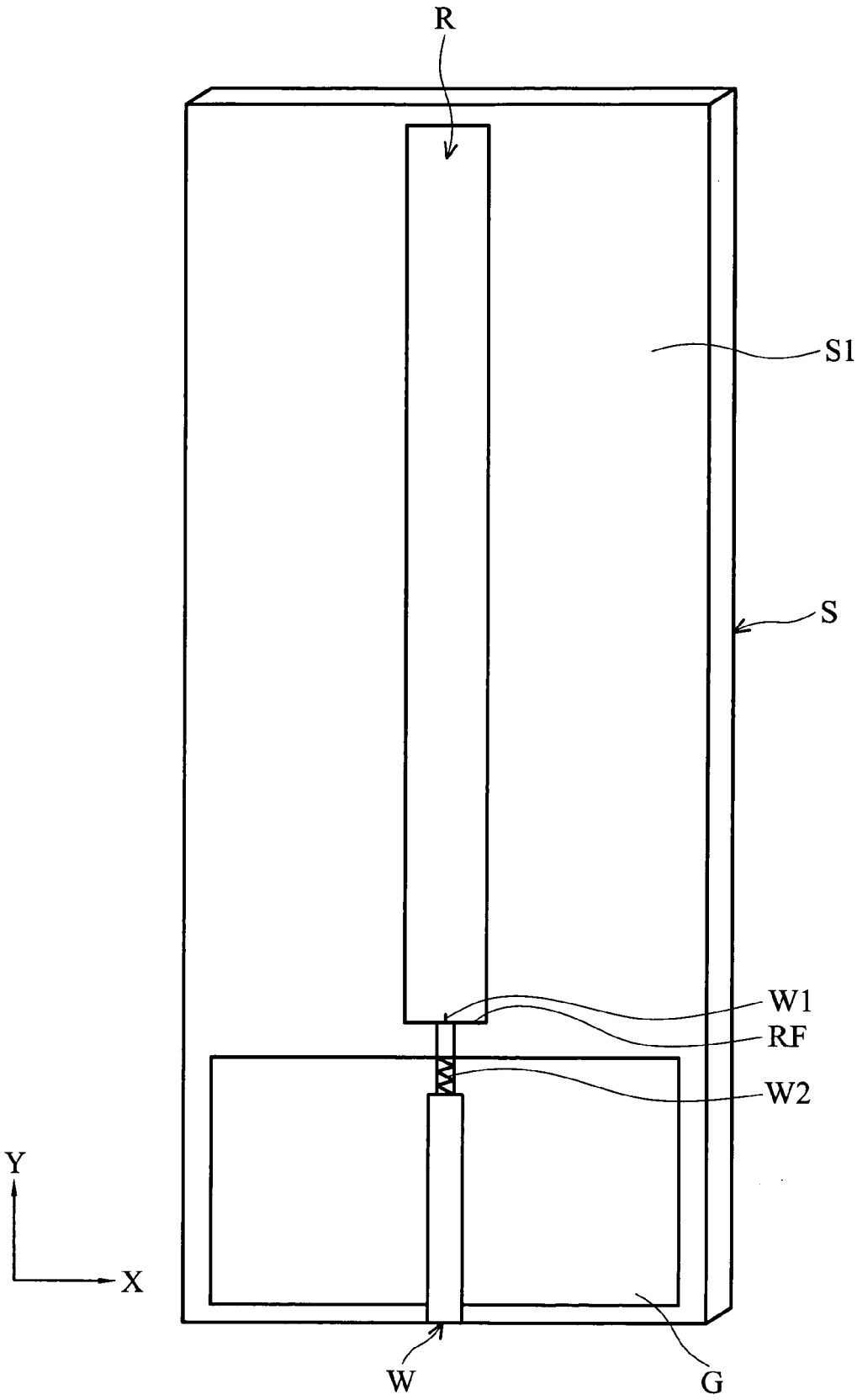
FIG. 1 (RELATED ART)
FIG. 1 is a perspective diagram of a conventional planar monopole antenna.
Figure 2:
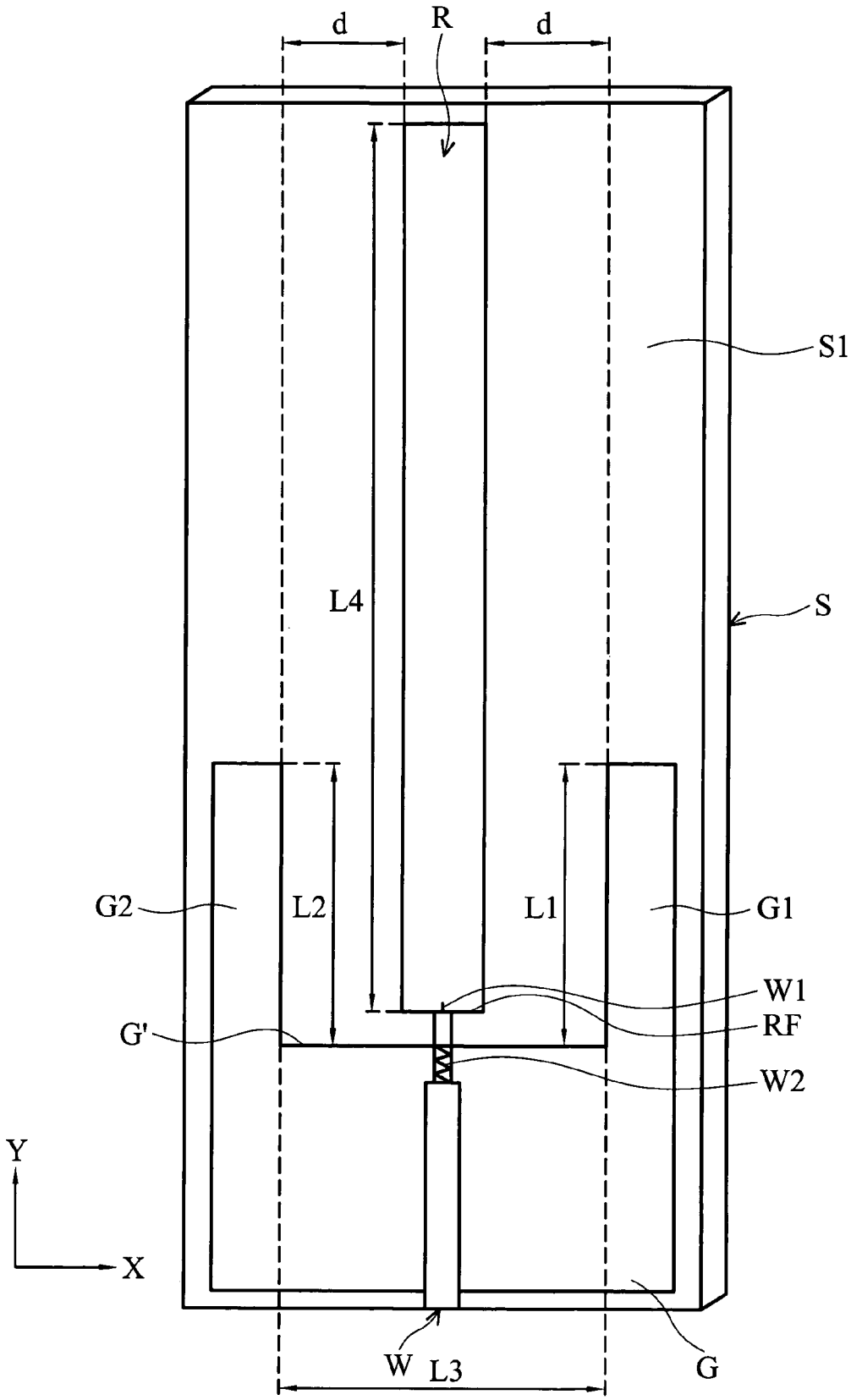
FIG. 2 is a perspective diagram of an embodiment of a planar monopole antenna.

Referring to FIG. 2, an exemplary embodiment of a planar monopole antenna for transmitting radio signals within a specific frequency range includes a substrate S, a ground G, a first sleeve G1, a second sleeve G2, a radiator R and a cable W. The ground G and the radiator R are formed on a surface S1 of the substrate S. As shown in FIG. 2, the radiator R is longitudinal along axis Y, comprising a feed end RF at the bottom thereof, adjacent to a side G' of the ground G. The cable W, such as a coaxial cable, comprises a signal wire W1 and a ground wire W2 enclosing the signal wire W1. The radiator R comprises a feed end RF adjacent to the ground G. The feed end RF is connected to the signal wire W1, and the ground G is connected to the ground wire W2, respectively.

In FIG. 2, the first and second sleeves G1 and G2 are parallel, formed on the surface S1, extending from the ends of the side G'. The first sleeve G1 has a first length L1, and the second sleeve G2 has a second length L2 along Y axis, respectively. The first length L1 is substantially equal to the second length L2. In some embodiments, the substrate S is FR4(Flame Retardant Type 4), and the ground G, the first and second sleeves G1 and G2 are metal, integrally formed on the surface S1 by PCB fabrication.

As shown in FIG. 2, the side G' is perpendicular to Y axis, defining a third length L3 equal to the distance from the first sleeve G1 to the second sleeve G2. The radiator R has a fourth length L4 along Y axis, and the distance d from the radiator R to the first sleeve G1 is substantially equal to the distance d from the radiator R to the second sleeve G2. The fourth length L4 is designed substantially equal to ¼ of the radio signal wavelength. Specifically, the fourth length L4 is also substantially equal to the sum of the first, second and third lengths L1, L2 and L3 (L4=L1+L2+L3). Thus, the radiator R, the first and second sleeves G1 and G2 can exhibit capacitive effect and facilitate broader bandwidth for wireless communication.

Figure 3:
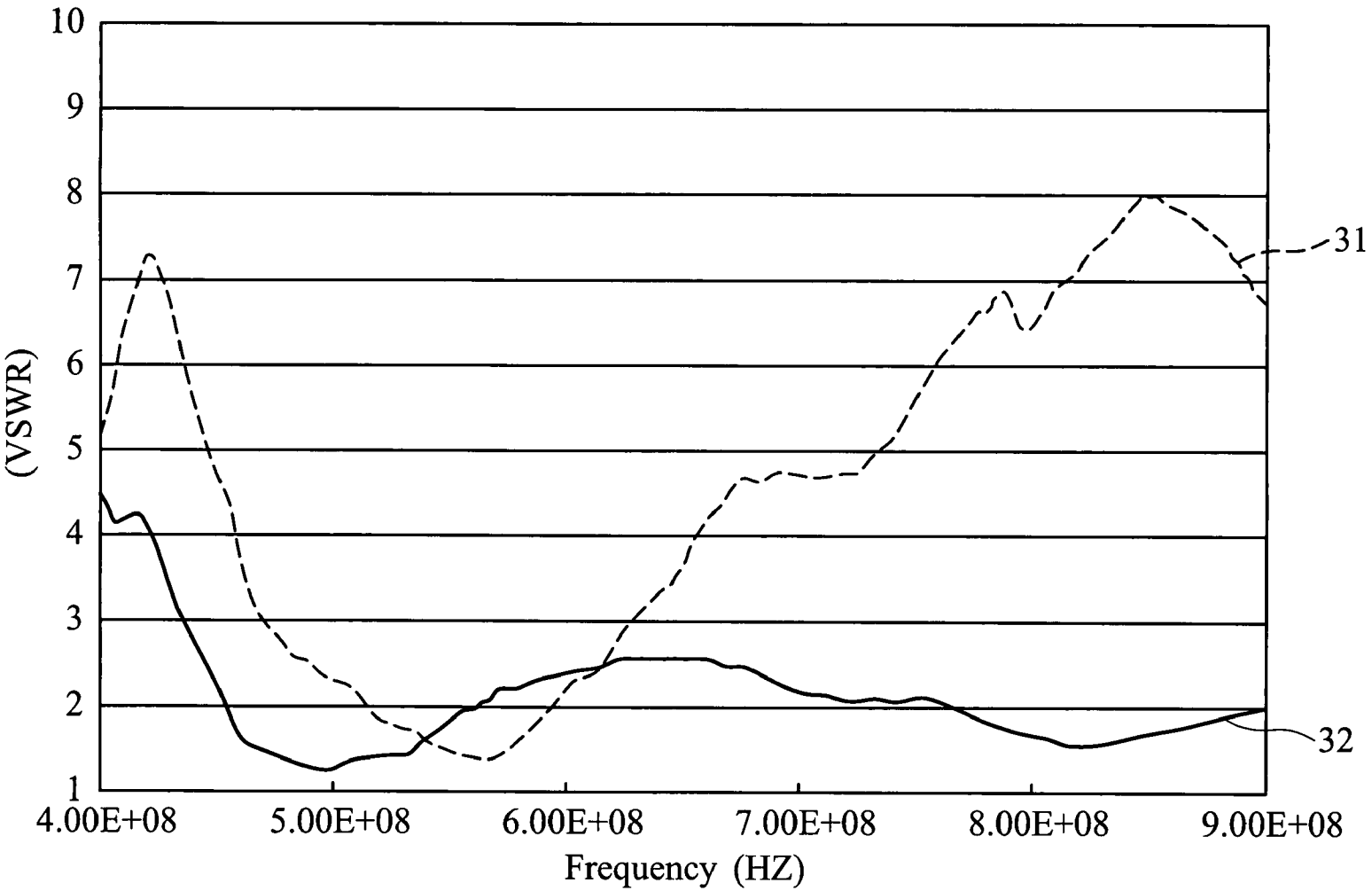
FIG. 3 is a perspective diagram illustrating VSWR between 400–900 MHz of a conventional planar monopole antenna and an embodiment of a planar monopole antenna.

FIG. 3 illustrates Voltage Standing Wave Ratio (VSWR) between 400–900 MHz of two planar monopole antennas. Dashed line 31 indicates VSWR between 400–900 MHz of a conventional planar monopole antenna, and solid line 32 indicates VSWR between 400–900 MHz of the planar monopole antenna as shown in FIG. 2 (L1=L2=65 mm, L3=12 mm, L4=140 mm).

In general, a standard antenna requires an available VSWR less than 3. With respect to FIG. 3, the frequency coverage ratio of the conventional planar monopole is about 25% (the proportion of the frequency range under VSWR<3 indicated by dashed line 31 within 400–900 MHz), and the frequency coverage ratio of the planar monopole antenna in FIG. 2 is about 90% (the proportion of the frequency range under VSWR<3 by solid line 32 within 400–900 MHz). That is, the planar monopole antenna of the embodiment can provide higher frequency coverage ratio and broader communication bandwidth than the conventional planar monopole antenna.

Figure 4:
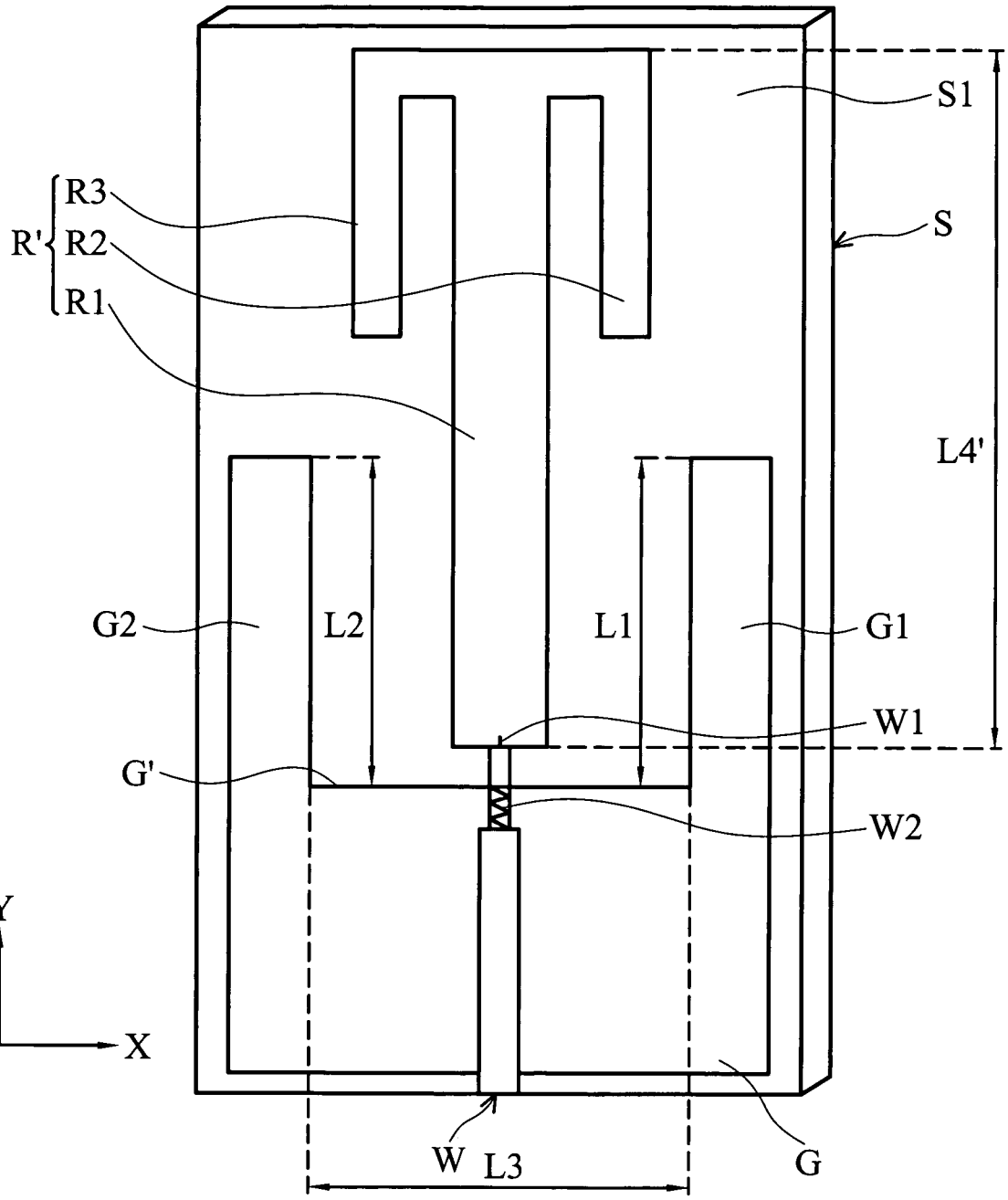
FIG. 4 is a perspective diagram of another embodiment of a planar monopole antenna.

Referring to FIG. 4, another embodiment of a planar monopole antenna comprises a deformed radiator R' to reduce the extent of the antenna in direction Y and facilitate miniaturization. The radiator R' has a main body R1 and a pair of L-shaped angle portions R2 and R3, both symmetrical with respect to the main body R1. Specifically, total length of the main body R1 and each of the angle portions R2 and R3 is substantially equal to the sum of the first, second and third lengths L1, L2 and L3, and substantially equal to ¼ of the radio signal wavelength. Thus, the radiator R', the first and second sleeves G1 and G2 can provide capacitive effect and facilitate broader bandwidth for wireless communication.

As shown in FIG. 4, the main body R1 extends along Y axis, and the angle portions R2 and R3 symmetrically extend outward from an end of the main body R1. Specifically, the angle portions R2 and R3 extend opposite to Y axis. As the sum of first, second and third lengths L1, L2 and L3 are predetermined, the radiator R' can have a length L4' extending less in direction Y, reducing antenna dimension. The length L4' in direction Y in FIG. 4 is less than the length L4 shown in FIG. 2.

Figure 5:
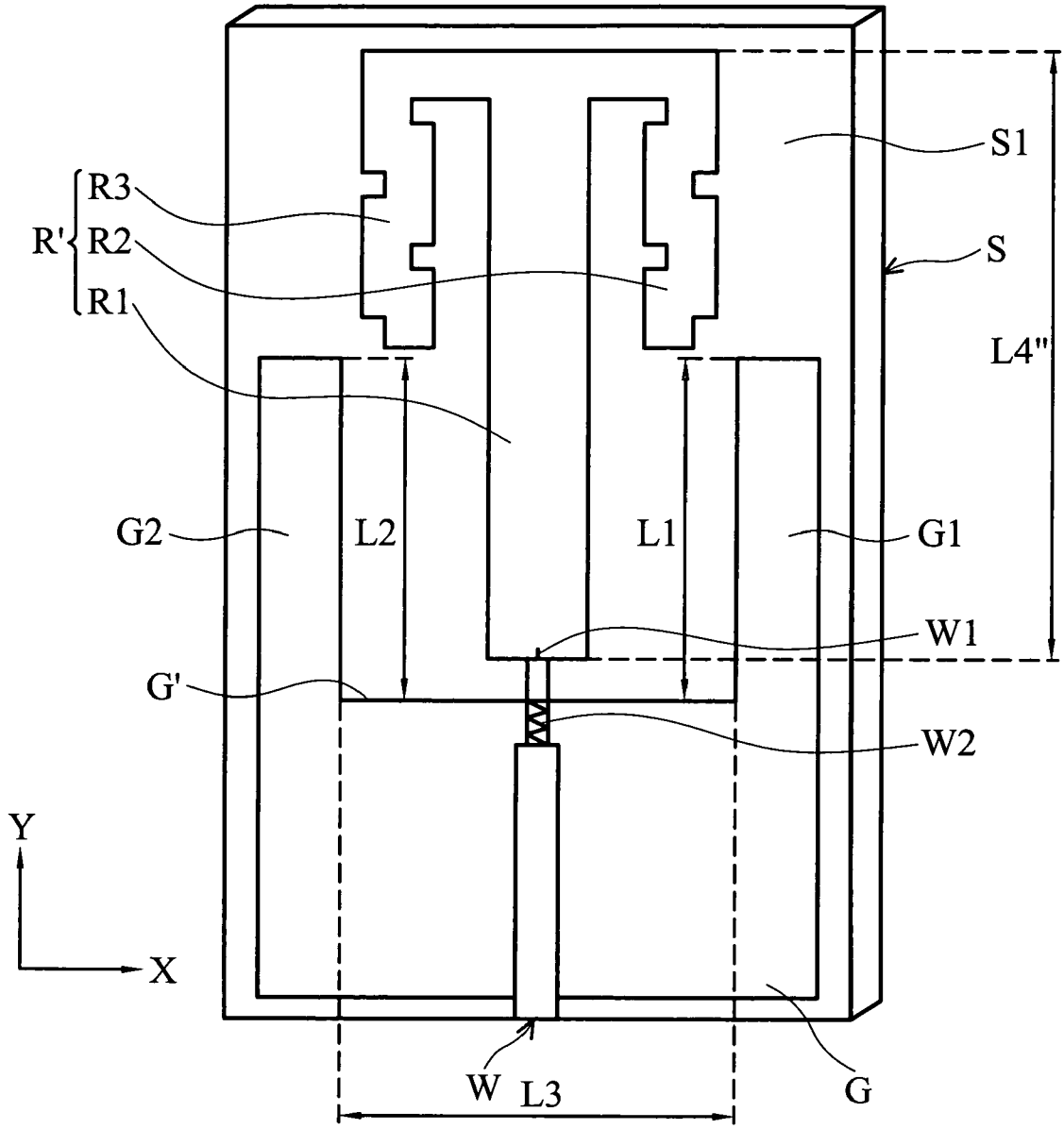
FIG. 5 is a perspective diagram of an embodiment of a planar monopole antenna with zigzag structures.

To save more space on the surface S1 of the substrate S, referring to FIG. 5, an embodiment of a planar monopole antenna comprises a pair of angle portions R2 and R3 with zigzag structures, to reduce the extent of the radiator R' in direction Y. Total length of the main body R1 and each of the angle portions R2 and R3 is substantially equal to the sum of the first, second and third lengths L1, L2 and L3, and substantially equal to ¼ of the radio signal wavelength. Thus, the radiator R', the first and second sleeves G1 and G2 can provide capacitive effect and facilitate broader bandwidth for wireless communication. Comparing FIG. 2 with FIGS. 4 and 5, when the total length of the first, second and third lengths L1, L2 and L3 is predetermined, the extent of the radiator R' in direction Y can be reduced to facilitate miniaturization, wherein L4"<L4'<L4.

Planar monopole antennas with symmetric sleeve structures are provided according to the embodiments. The sleeves can be printed on a substrate by PCB fabrication, exhibiting capacitive effect with the radiator, thereby facilitating broader bandwidth for wireless communication. Moreover, the extent of the radiator can be reduced in various structures to facilitate miniaturization. The invention can provide broader bandwidth than conventional planar monopole antennas for wireless communication, suited for various types of DVB devices, such as digital TVs.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A planar monopole antenna for communicating a radio signal, comprising:

a substrate;

a ground;

a first sleeve, formed on the substrate and electrically connected to the ground, wherein the first sleeve projects from a side of the ground in a first direction with a first length;

a second sleeve, formed on the substrate and electrically connected to the ground, wherein the first sleeve projects from the side of the ground in the first direction with a second length, and the side of the ground defines a third length from the first sleeve to the second sleeve;

a radiator, formed on the substrate and situated between the first and second sleeves, wherein the radiator has a fourth length in the first direction, substantially equal to the sum of the first, second, and third lengths; and a cable, connecting the radiator for communicating the radio signal.

2. The planar monopole antenna as claimed in claim 1, wherein the ground, the radiator, the first and second sleeves are formed on a surface of the substrate.

3. The planar monopole antenna as claimed in claim 1, wherein the distance from the radiator to the first sleeve is substantially equal to the distance from the radiator to the second sleeve.

4. The planar monopole antenna as claimed in claim 1, wherein the first and second sleeves are substantially perpendicular to the side of the ground.

5. The planar monopole antenna as claimed in claim 1, wherein the fourth length is substantially ¼ of the radio signal wavelength.

6. The planar monopole antenna as claimed in claim 1, wherein the first length is substantially equal to the second length.

7. The planar monopole antenna as claimed in claim 1, wherein the substrate is FR4 (Flame Retardant Type 4).

8. The planar monopole antenna as claimed in claim 1, wherein the ground, the radiator, the first and second sleeves are printed on a surface of the substrate by PCB fabrication.

9. The planar monopole antenna as claimed in claim 1, wherein the radiator comprises a feed end adjacent to the side of the ground, and the cable comprises a ground wire connecting the ground and a signal wire connecting the feed end.

10. The planar monopole antenna as claimed in claim 8, wherein the cable is a coaxial cable, and the ground wire encloses the signal wire.

11. A planar monopole antenna for communicating a radio signal, comprising:

a substrate;

a ground;

a first sleeve, formed on the substrate and electrically connected to the ground, wherein the first sleeve projects from a side of the ground in a first direction with a first length;

a second sleeve, formed on the substrate and electrically connected to the ground, wherein the second sleeve projects from the side of the ground in the first direction with a second length, and the side of the ground defines a third length from the first sleeve to the second sleeve;

a radiator, formed on the substrate and situated between the first and second sleeves, wherein the radiator comprises a main body and two L-shaped angle portions symmetrical with respect to the main body, wherein the angle portions substantially extend opposite to the first direction, and total length of the main body and each of the angle portions is substantially equal to the sum of the first, second, and third lengths; and a cable, connecting the radiator for communicating the radio signals.

12. The planar monopole antenna as claimed in claim 11, wherein each of the angle portions comprises a zigzag structure.

13. The planar monopole antenna as claimed in claim 11, wherein the ground, the radiator, the first and second sleeves are formed on a surface of the substrate.

14. The planar monopole antenna as claimed in claim 11, wherein the distance from the radiator to the first sleeve is substantially equal to the distance from the radiator to the second sleeve.

15. The planar monopole antenna as claimed in claim 11, wherein the first and second sleeves are substantially perpendicular to the side of the ground.

16. The planar monopole antenna as claimed in claim 11, wherein the fourth length is substantially ¼ of the radio signal wavelength.

17. The planar monopole antenna as claimed in claim 11, wherein the first length is substantially equal to the second length.

18. The planar monopole antenna as claimed in claim 11, wherein the substrate is FR4 (Flame Retardant Type 4).

19. The planar monopole antenna as claimed in claim 18, wherein the ground, the radiator, the first and second sleeves are printed on a surface of the substrate by PCB fabrication.

20. The planar monopole antenna as claimed in claim 11, wherein the radiator comprises a feed end adjacent to the side of the ground, and the cable comprises a ground wire connecting the ground and a signal wire connecting the feed end.

* * * * *